US011243043B1

(12) United States Patent
Rentz

(10) Patent No.: US 11,243,043 B1
(45) Date of Patent: Feb. 8, 2022

(54) PULL TENSION ARCHERY RELEASE

(71) Applicant: Gregory E. Summers, Madison Heights, VA (US)

(72) Inventor: Marc Rentz, Madison Heights, VA (US)

(73) Assignee: Gregory E. Summers, Madison Heights, VA (US), Trust Agreement Dated Dec. 8, 2006

( * ) Notice: Subject to any disclaimer, the term of this patent is extended or adjusted under 35 U.S.C. 154(b) by 0 days.

(21) Appl. No.: 17/155,677

(22) Filed: Jan. 22, 2021

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 4,620,523 A * 11/1986 Peck ..... F41B 5/1469 124/35.2
4,674,469 A * 6/1987 Peck ..... F41B 5/1438 124/32
4,691,683 A * 9/1987 Peck ..... F41B 5/1469 124/35.2
5,103,796 A * 4/1992 Peck ..... F41B 5/1469 124/35.2
5,694,915 A 12/1997 Summers
6,481,480 B1 * 11/2002 Schuster ..... B60C 11/11 152/209.18
6,925,995 B1 * 8/2005 McConnell ..... F41B 5/1469 124/35.2
8,276,575 B1 * 10/2012 Gillig ..... F41B 5/1469 124/35.2
8,622,051 B2 1/2014 Summers et al.

* cited by examiner

*Primary Examiner* — John A Ricci
(74) *Attorney, Agent, or Firm* — Leading Edge Law Group PLC

(57) ABSTRACT

A pull tension archery release includes a housing having a longitudinal axis and a sear assembly configured by engaging a bow string. A sear is arranged within the housing for reciprocal movement along the longitudinal axis between hold and fire positions to engage and release a rotary bail which grips the bow string. When pull tension is applied to the sear, the sear is displaced to release the bail and fire an arrow. The sear assembly is adjustable to enable the release to operate in both pull tension and relax trigger modes.

16 Claims, 8 Drawing Sheets

PULL TENSION ARCHERY RELEASE

BACKGROUND OF THE INVENTION

The present invention relates to an archery release, and more particularly to a pull tension archery release for a bowstring suitable for use with multiple shooting styles.

Release devices are used in archery to assist the archer in pulling a bowstring to a fully drawn position and then releasing the bowstring to fire an arrow. Some release devices use grippers for engaging the bowstring or a nock mounted on the bowstring. Other release devices use a rope looped about the bowstring. The present invention relates to a new release which can be activated by releasing a locking mechanism via index finger and thumb pieces or by pull through tension exceeding bow let-off poundage.

BRIEF DESCRIPTION OF THE PRIOR ART

Back-tension release devices which reduce torque are well-known in the prior art as evidenced by U.S. Pat. No. 5,694,915. This patent discloses a back-tension rope release in which a catch for a rope loop is connected with a fork which in turn is connected with a handle. The orientation of the fork relative to the handle is adjustable in order to remove torque or twist from a rope loop. The catch is also adjustable relative to the fork in order to adjust the back-tension travel to fire the bow. Set screws are used to hold the fork and the catch in the desired positions.

Another back-tension release device is disclosed in U.S. Pat. No. 8,622,051 wherein an adjustable sear housing and an adjustable finger are provided. By adjusting the sear housing, twist or torque in a bowstring loop connected with the release can be eliminated. The speed of the release is altered via adjustment of the finger.

While the prior devices normally operate satisfactorily, they are somewhat cumbersome to operate and often require re-adjustment because the set screws loosen during repeated firing of the release. In addition, they do not accommodate various shooting styles.

SUMMARY OF THE INVENTION

The present invention was developed in order to overcome these and other drawbacks of prior archery releases by providing a pull tension archery release. The release includes a head, a bail rotatably connected with the head and including at least one radially extending projection configured to hold a bow string. In a preferred embodiment, three equally spaced projections are provided on the bail. A sear assembly is operable between a hold position where the sear assembly engages the bail to prevent rotation of the bail and a release position wherein the sear assembly releases the bail for rotation to release the bow string and fire an arrow. A cylindrical housing having a longitudinal axis is connected with the head, and a sear is arranged in the housing along the longitudinal axis. When pull tension is applied to the sear, the sear is displaced away from the bail to release the bow string.

A cylindrical pull sleeve is connected with the sear. The pull sleeve has a cylindrical configuration and contains a chamber within which the housing is arranged. A locking assembly is connected with the head and the sear to lock the head in a fixed position relative to the housing. The locking assembly preferably includes a finger lock and a thumb lock both of which are pivotally connected with the head and preferably arranged on opposite sides thereof. Within the head, the ends of the finger and thumb locks are configured to engage an annular groove in the sear in a locked position. When sufficient pull tension is applied to the pull sleeve, the archer may release the finger and thumb locks to release the sear from its hold position. Alternatively, if insufficient pull tension is applied to the pull sear and the finger and thumb locks are released, additional pull tension may be applied by the archer to surpass the bow let-off poundage and thus release the sear.

A spring is arranged with the housing between the spring and the housing to bias the sear toward the hold position. An adjustable nut is arranged within the housing and abuts against the spring. The nut is threadably connected with the housing and operable to adjust the biasing force of the spring on the sear.

BRIEF DESCRIPTION OF THE FIGURES

Other objects and advantages of the invention will become apparent from a study of the following specification when viewed in the light of the accompanying drawing, in which.

DETAILED DESCRIPTION

As shown in FIGS. 1-5, the pull tension archery release 2 according to the invention includes an outer pull sleeve 4 having a generally cylindrical configuration with a longitudinal axis and containing a chamber in which a generally cylindrical housing 6 is arranged. The housing is coaxial with the pull sleeve, and as will be developed below, the pull sleeve slides relative to the housing.

Figure 1:
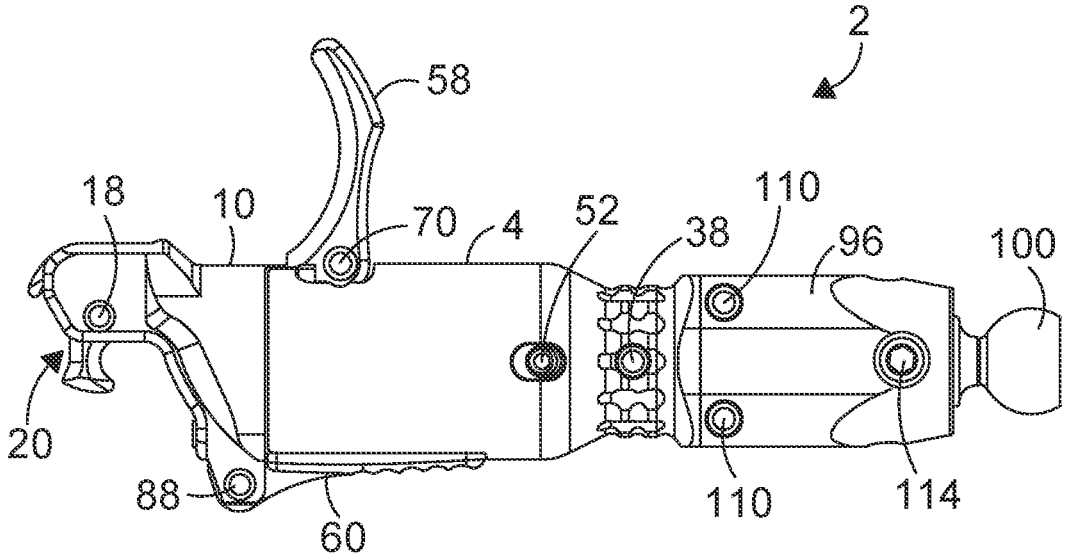
FIGS. 1 and 2 are front elevation and front sectional views, respectively, of the pull tension archery release according to the invention in a hold condition.
Figure 2:
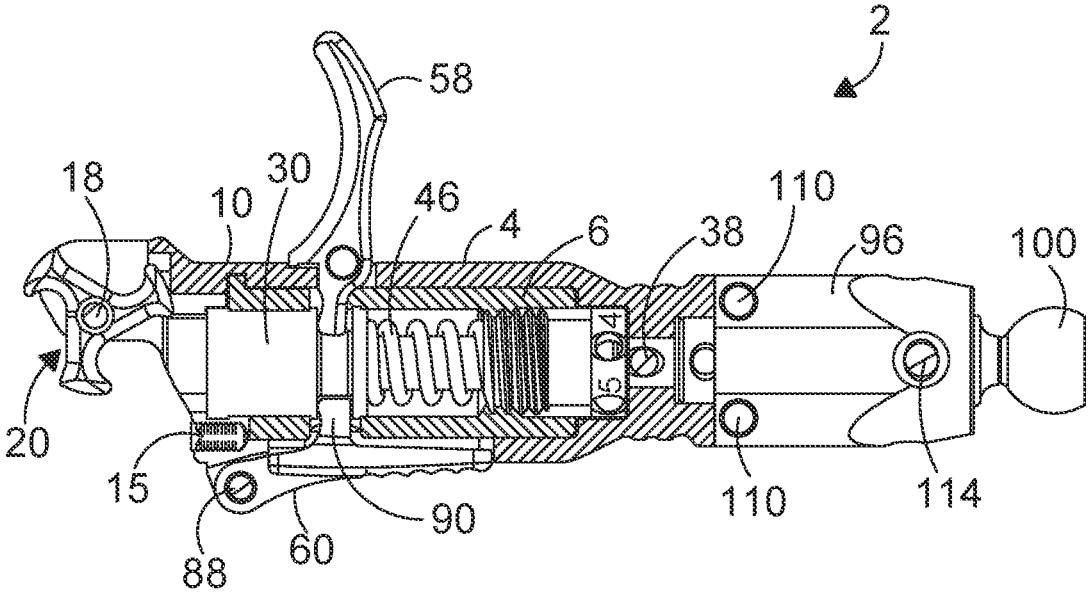
Figure 3:
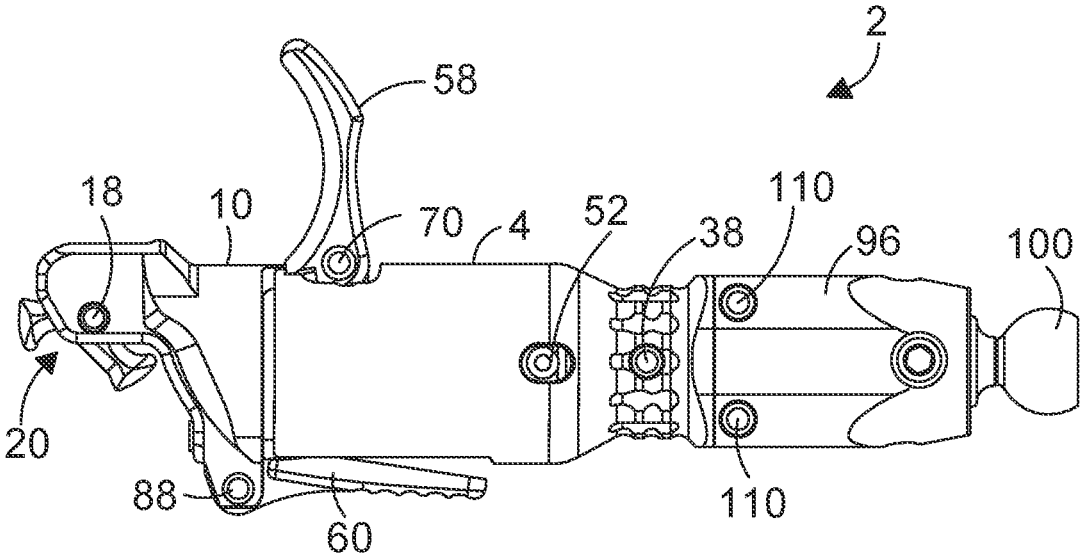
FIGS. 3 and 4 are front elevation and front sectional views, respectively, of the release of FIG. 1 in a release condition.
Figure 4:
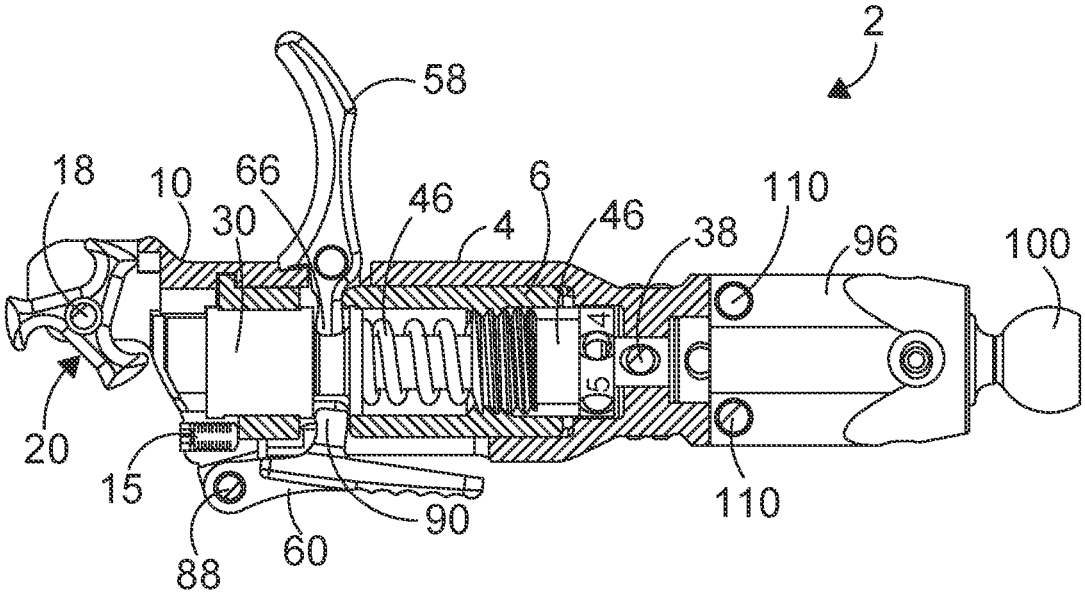
Figure 12:
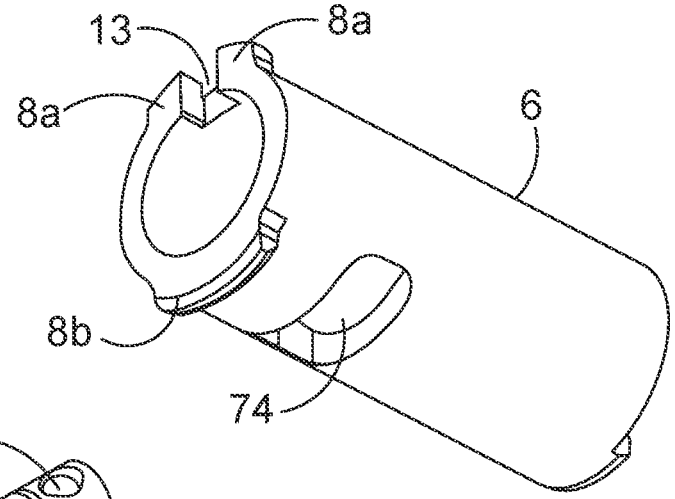
FIGS. 12 and 13 are perspective and front elevation sectional views, respectively, of the spring housing of the archery release according to the invention.
Figure 13:
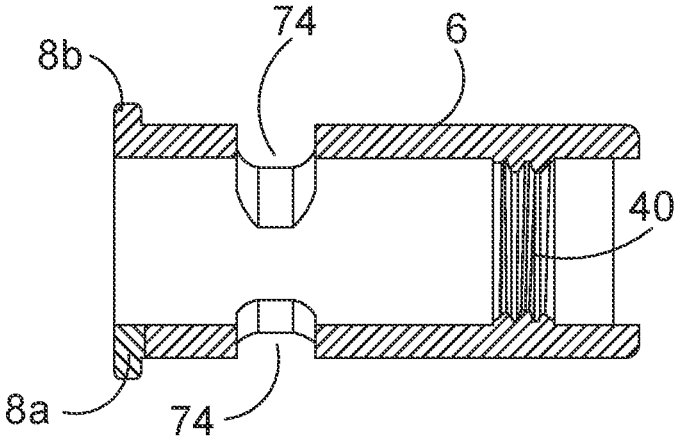
Figure 16:
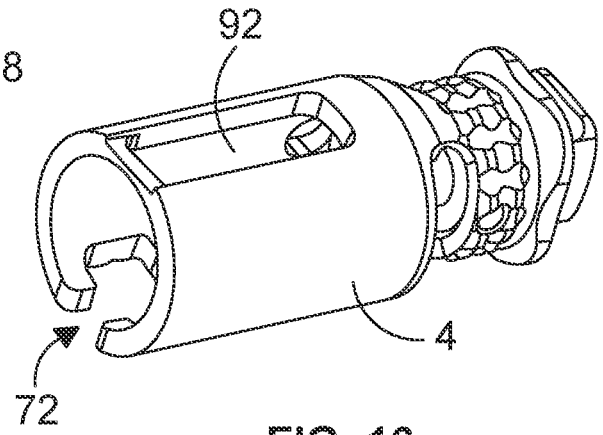
FIGS. 16-18 are bottom perspective, front elevation, and bottom plan views, respectively, of the pull sleeve of the archery release according to the invention
Figure 17:
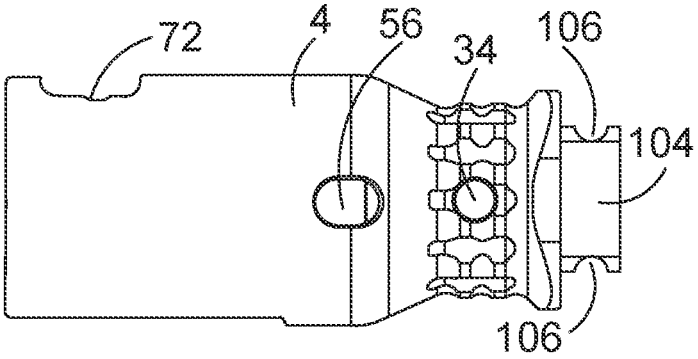
Figure 18:
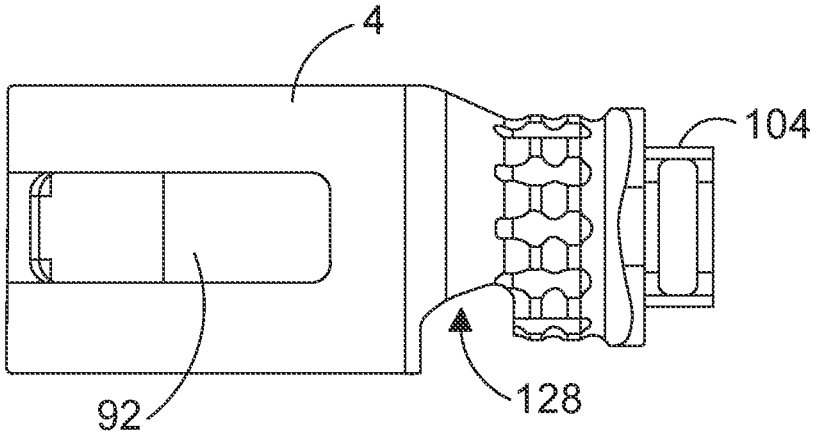

The pull sleeve is shown in detail in FIGS. 16-18 and the housing 6 is shown in detail in FIGS. 12 and 13. At one end, the housing has radial projections 8*a* and 8*b*. More particularly, two spaced projections 8*a* extend from one surface of the housing and a single continuous projection 8*b* extends from an opposite surface of the same end of the housing. The projections serve to connect the housing with a head 10 arranged at one end of the pull sleeve as shown in FIGS. 1-4. The head is shown in detail in FIGS. 6 and 7. More particularly, the head contains an inner chamber extending from a bottom of the head as shown in FIG. 7. An annular recess 12 is arranged in an inner surface of the head and communicates with the chamber. The radial projections 8*a* and 8*b* of the housing are arranged in the annular recess of the head to connect the head with the housing as shown in FIGS. 2 and 4. A recess 13 is provided in the housing between the two spaced projections 8*a* as shown in FIG. 12, and a threaded opening 14 is provided in the head and aligned with the housing recess 13 when the head and housing are connected. A screw 15 is inserted into the head threaded opening 14 and into the housing recess 13 to prevent the housing from rotating about its axis relative to the head.

Figure 6:
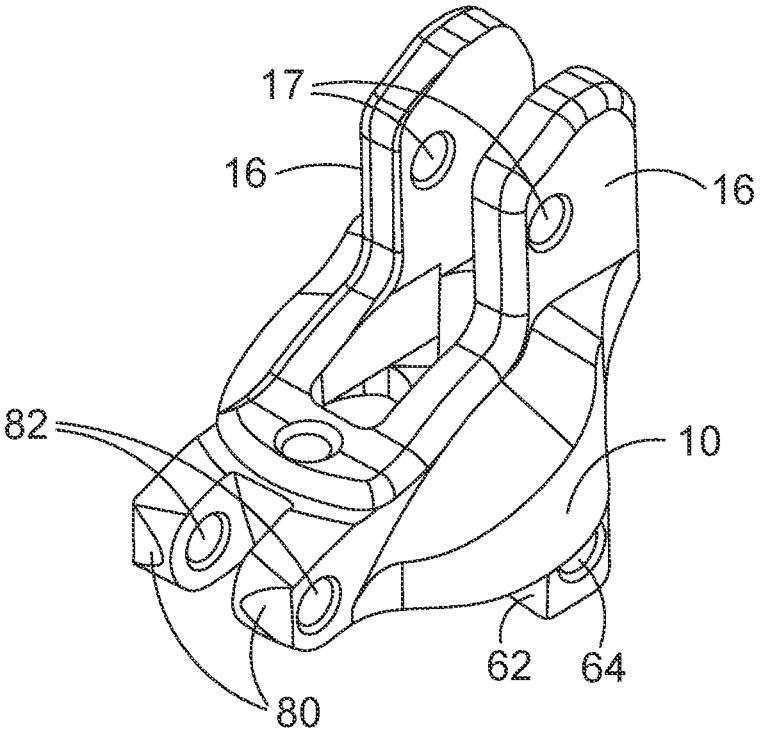
FIGS. 6 and 7 are top and bottom perspective views, respectively, of the head of the archery release according to the invention.
Figure 7:
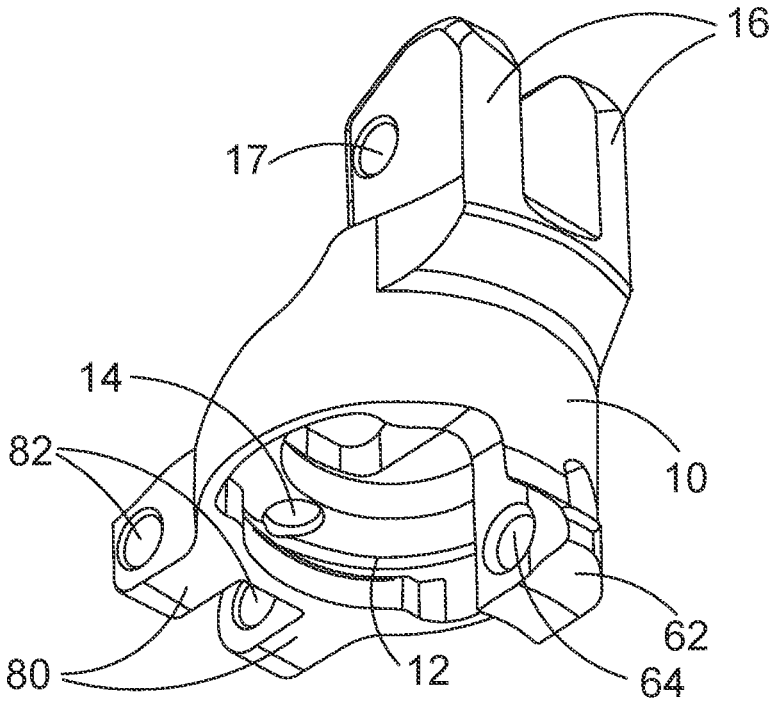
Figure 8:
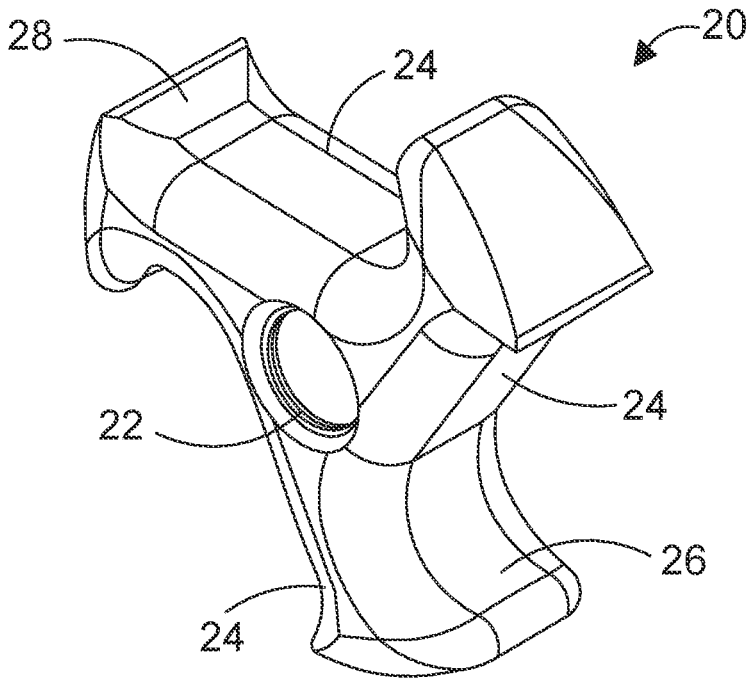
FIGS. 8 and 9 are perspective and front elevation views, respectively, of the bail of the archer release according to the invention.
Figure 9:
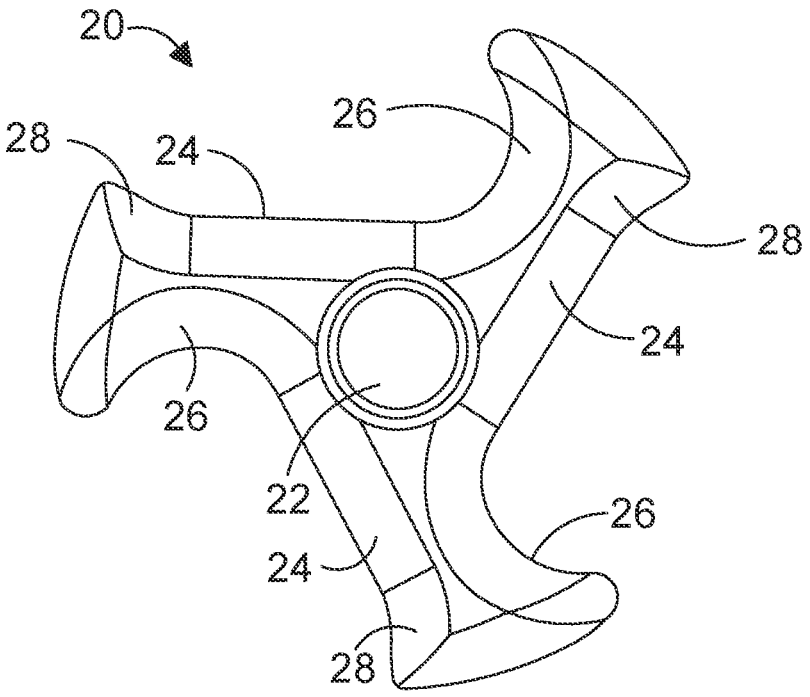

The head includes a pair of extensions 16 at the top as shown in FIGS. 6 and 7. Each projection contains an opening 17, the openings being aligned to receive a dowel pin 18. A bail 20 is connected with the head. More particularly, the bail is arranged between the projections of the head and contains a central opening 22 and at least one radial projection 24 as shown in detail in FIGS. 8 and 9. The dowel pin 18 passes through the central opening to rotatably connect the bail with the head. As shown in FIGS. 1-4, the axis of rotation of the bail is perpendicularly to the longitudinal axis of the pull sleeve and housing. In a preferred embodiment, the bail includes three projections which are equally spaced from each other. The ends of each projection include a concave portion 26 configured to hold or receive a bow string, not shown. Behind the concave portion, each bail projection end includes a flattened portion 28 which acts as a stop or abutment as will be described below.

Figure 10:
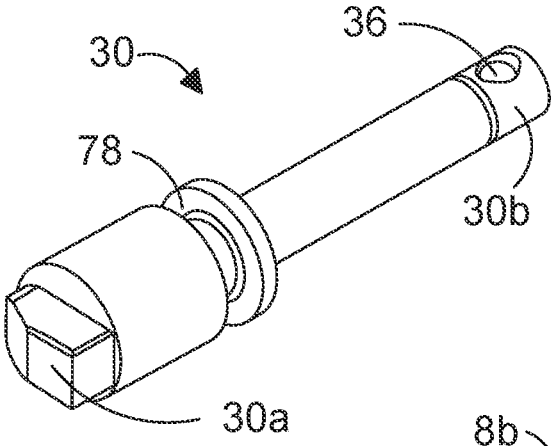
FIGS. 10 and 11 are perspective and front elevation views, respectively, of the sear of the archery release according to the invention.
Figure 11:
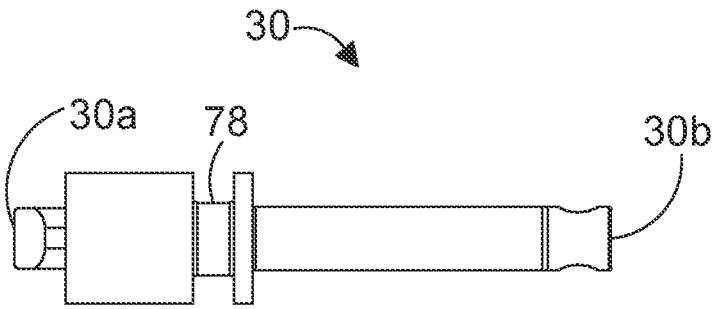

The pull tension archer release includes a sear assembly operable between a hold position wherein the sear assembly engages the bail to prevent its rotation and a release position wherein the sear assembly releases the bail for rotation to in turn release the bow string and fire an arrow. More particularly, the sear assembly includes a sear 30 having a longitudinal axis coaxial with the pull sleeve and the housing. The sear is shown in detail in FIGS. 10 and 11. A first or front end 30*a* of the sear is configured to engage a flattened portion of a projection of the bail as shown in FIG. 2. A second or rear end 30*b* of the sear is connected with the pull sleeve 4. For this purpose, the pull sleeve contains an opening 34 in a rear portion thereof and the second end 30*b* of the sear contains an opening 36 which is aligned with the pull sleave openings 34. A dowel pin 38 passes through the aligned openings 34 and 36 to connect the sear with the pull sleeve. When pull tension is applied to the pull sleeve to move the sleeve away from the head 10, the sear is also displaced along the longitudinal axis relative to the housing 6 so that the first end 30*a* of the sear is pulled away from the flattened portion of the bail as shown in FIG. 4 allowing the bail to rotate and release a bow string owing to the pressure applied to the string from the pull tension.

Figure 14:
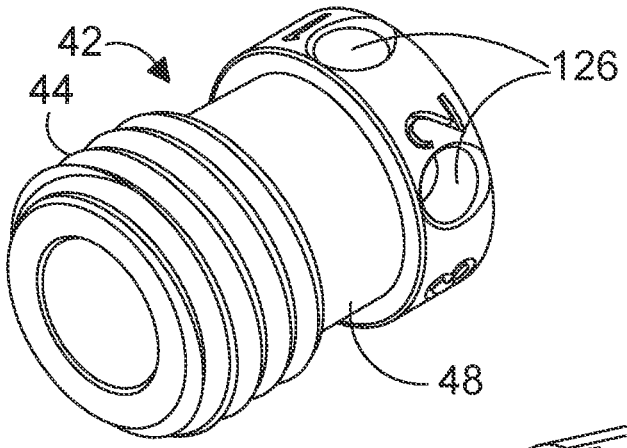
FIGS. 14 and 15 are perspective and front elevation views, respectively, of the adjustable nut of the archery release according to the invention.
Figure 15:
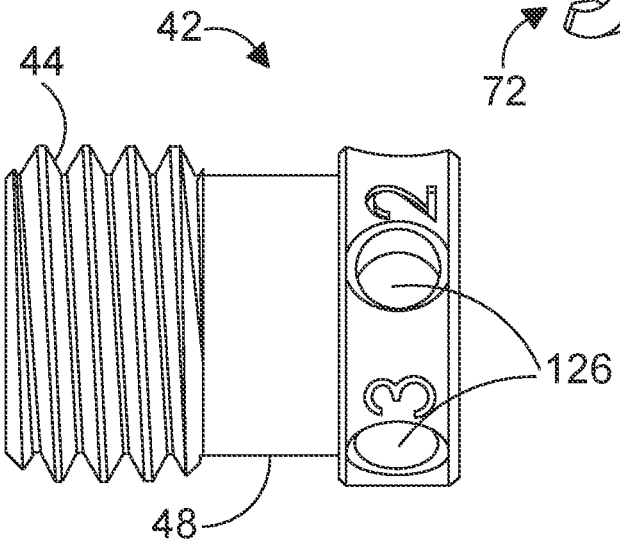

As shown in FIG. 13, the inner wall of the housing 6 includes a threaded region 40. The release further includes a nut 42 which is arranged within the housing and includes a threaded portion 44 for rotatable connection with the threaded region of the housing. The nut is shown in detail in FIGS. 14 and 15. Rotation of the nut displaces the nut along the longitudinal axis of the housing and sleeve relative to the housing. A spring 46 is also arranged in the housing and extends between the sear 30 and the nut 42 as shown in FIGS. 2 and 4. Rotation of the nut relative to the housing adjusts the biasing force applied to the spring 46 which in turn controls the release of the sear as will be developed below.

Referring once again to FIGS. 14 and 15, an intermediate portion 48 of the nut has a reduced diameter. This portion of the nut is configured to receive a lock collar 50 (FIG. 5) which surrounds the nut. The lock collar is preferably formed of a synthetic plastic material such as nylon. A set screw 52 passes through a threaded opening 54 in the housing 6 and is operable to compress the lock collar 50 against the nut to lock it in a selected position following adjustment. Releasing the set screw from the lock collar allows the nut to rotate and adjust the spring tension. The pull sleeve 4 contains a pass through opening 56 aligned with the housing threaded opening 54 to afford access to the set screw 52 such as with an Allen wrench to turn the screw.

In order to prevent the release from firing unintentionally, a locking system for the sear assembly is provided. More particularly, the locking system includes a finger lock 58 and a thumb lock 60 which are configured for engagement by the index finger and thumb, respectively, of the archer.

Figure 5:
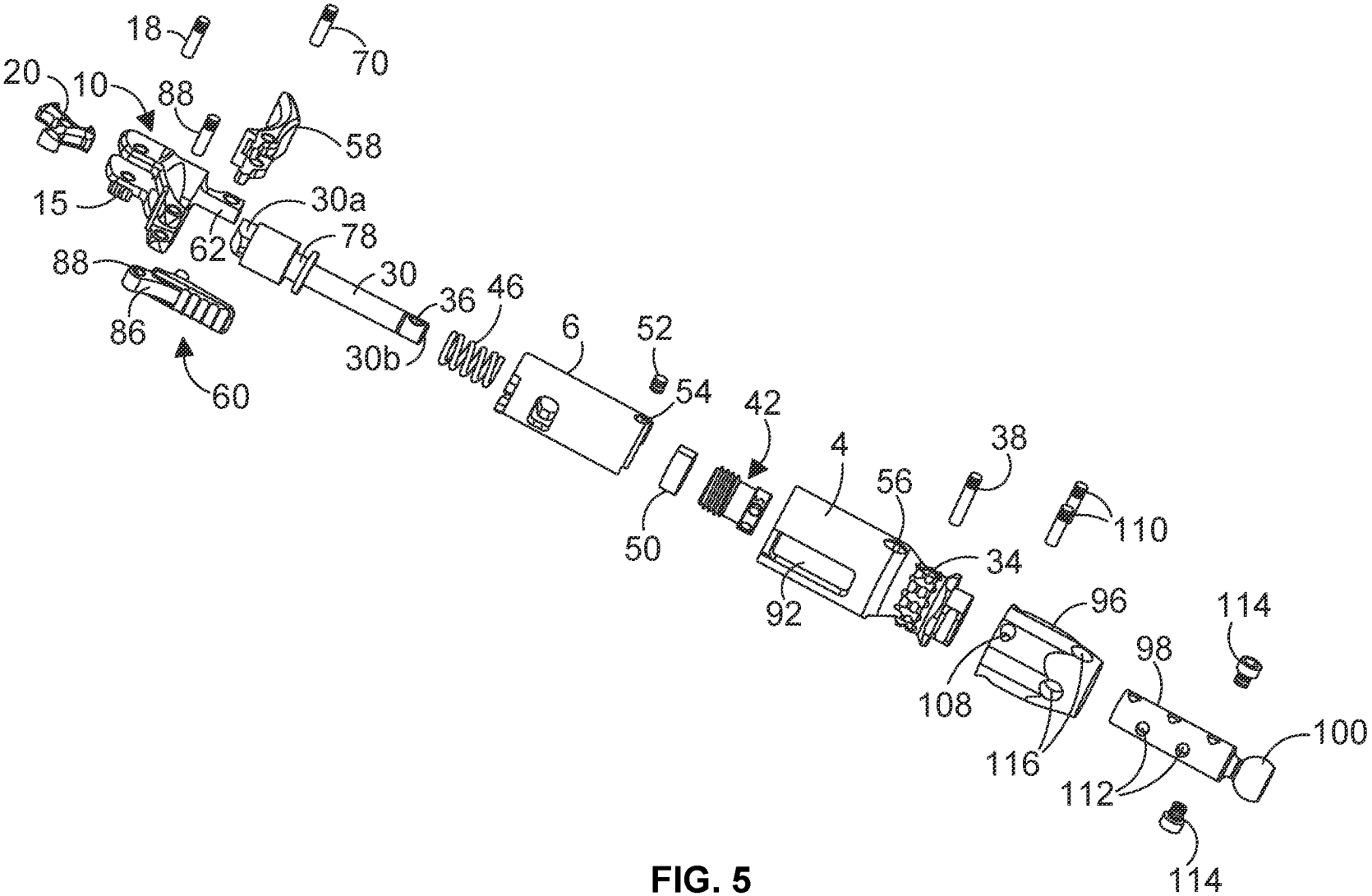
FIG. 5 is an exploded view of the archery release according to the invention.
Figure 19:
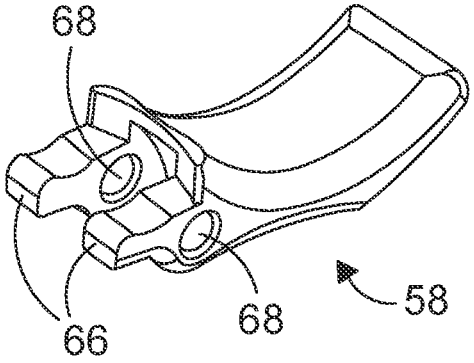
FIG. 19 is a perspective view of a finger lock of the archery release according to the invention.

Referring to FIGS. 5, 7 and 19, the head 10 includes a projection 62 extending from a lower portion thereof and which contains an opening 64. The finger lock 58 includes a pair of spaced projections 66 which contain aligned openings 68. The head projection 62 is arranged between the finger lock projections 66 and a dowel pin 70 passes through the aligned openings of the finger lock projections and the head projection to pivotally connect the finger lock with the head. The pivot axis of the finger lock is normal to the longitudinal axis of the pull sleeve. The free end portions of the finger lock projections 66 extend through a slot 72 in the pull sleeve 4 and through a slot 74 in the housing and into an annular recess 78 in the outer surface of the sear 30 as shown in FIGS. 2 and 4.

Figure 20:
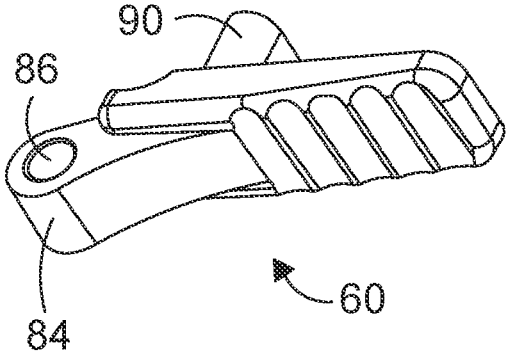
FIG. 20 is a perspective view of a thumb lock of the archery release according to the invention.
Figure 22:
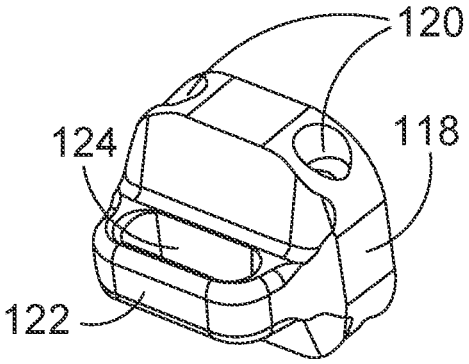

The head 10 further includes a pair of spaced parallel projections 80 extending downwardly as shown in FIGS. 1, 3, 6 and 7. These projections 80 contain aligned openings 82. The thumb lock 60, which is also shown in detail in FIG. 20, includes a projection 84 containing an opening 86. The thumb lock projection is arranged between the downwardly extending head projections 80 and a dowel pin 88 passes through the aligned openings of the head downward projections 80 and the thumb lock projection 84 to pivotally connect the thumb lock with the head. The pivot axis of the thumb lock is normal to the longitudinal axis of the pull sleeve. The thumb lock further includes an upper projection 90 which extends through a slot 92 in the pull sleeve 4 and through a slot 94 in the housing and into the annular recess 78 of the sear.

Pull tension to operate the release is preferably provided by the archer via a wrist strap (not shown) which is commonly used in the archery field. A fitting is connected with the release to accommodate a wrist strap. Referring to FIGS. 1-5 and 21, a universal fitting according to a preferred embodiment of the invention is shown. The universal fitting includes a removable hollow base 96 arranged over a free end of the pull sleeve 4 and a universal coupling pin 98 axially arranged within the base and having a coupler 100 extending from an opening 102 in the end of the base. The end of the pull sleeve includes a projection 104 containing a pair of concave recesses 106 on opposite sides thereof. The base contains a pair of spaced openings 108 which are aligned with the concave recesses when the base is arranged on the free end of the pull sleeve with the coupling pin within the base. A pair of dowel pins 110 pass through the openings and into the respective recesses to connect the base with the pull sleeve. The coupling pin 98 contains a plurality of spaced threaded openings 112 along the length thereof which allow the extent of the coupler 100 relative to the base to be adjusted. A pair of screws 114 pass through openings 116 in the base into selected threaded openings 112 of the coupling pin to adjust the degree to which the coupler 100 extends from the base. A wrist strap (not shown) is connectable with the universal coupler 100 in a known manner.

Figure 21:
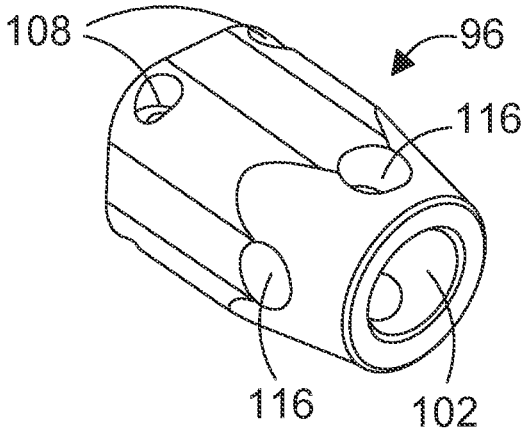
FIGS. 21 and 22 are perspective views, respectively of fittings of the archery release according to the invention for fastening a wrist strap to the release.

FIG. 21 shows an alternate fitting 118 for connecting a wrist strap with the release. The fitting 118 contains a pair of spaced openings 120 which receive the dowel pins 110. That is, the dowel pins pass through the openings 120 of the fitting 118 and into the concave recesses 106 in the projection of the pull sleeve 4 to connect the fitting with the pull sleeve. The end of the fitting includes an extension 122 containing a slot 124 for receiving a portion of the wrist strap in a known manner.

In operation, an archer places a bow string in the concave portion 26 of one of the projections 24 of the bail 20. The archer's index finger engages the finger lock 58 and the archer's thumb engages the thumb lock 60. The remaining fingers may be arranged around the pull sleeve. Tension is applied to the pull sleeve, primarily via a wrist strap connected with the rear portion of the release rather than through the gripping force of the archer's hand. With the finger and thumb locks engaged, they retain the sear in the hold position shown in FIGS. 1 and 2. Additional pull on the release draws the bow string while the sear is still held in the locked position. The archer then releases the finger and thumb locks to release the sear. Depending on the tension applied and the setting of the adjustable nut, the sear will either release or remain in the hold position until further tension—such as back tension—is applied. When the sear 30 is released, the sear first end 30*a* pulls away from the flattened portion 28 of the engaged bail projection allowing the bail to rotate under the force of the bow string and release the bow string to fire an arrow. FIGS. 3 and 4 show the release in the release position. Unlike the hold position shown in FIGS. 1 and 2, there is a gap between the head 10 and the pull sleeve 4 when the release is in the fire position.

It should be noted that with a tri-bail 20 having three projections 24, the projection that is engaged by the sear in the hold position is not the projection that grips a bow string. Thus in FIG. 2, the sear 30 engages a rearmost projection of the bail 20 while the projection extending from the bottom of the head 10 as shown in the figure is the projection that grips the string. For the next arrow to be fired, the projection that was previously release by the sear becomes the projection which grips the bow string and the projection that was not engaged either the bow string or the sear becomes the projection which is engaged by the sear owing to rotation of the bail in a clockwise direction in FIG. 4.

The adjustable nut 42 includes spaced openings 126 in the end portion of the nut opposite the threaded portion 44. These openings are accessible via a slot 128 in the pull sleeve 4 as shown in FIG. 18. When the set screw 52 which abuts against the locking collar 50 is released, a tool such as an Allen wrench may be inserted into an exposed opening 126 in the nut to rotate the nut. Rotation in a first direction squeezes the spring to increase its biasing force by closing space withing the housing between the nut and the sear while rotation in the opposite direction increases space between the nut and sear to un-squeeze or relax the spring that prevents the sear and bail from separating under bow let-off poundage. The nut can adjust the bow let-off poundage of the release from a maximum of approximately thirty-six pounds to less than three pounds.

Accordingly, when an archer chooses to use the release as a pull tension release, the archer rotates the adjustable nut in the first direction to increase poundage, i.e., by squeezing the spring tighter, to the point where the release holds five pounds more than the bow let-off poundage. When drawing the bow, the archer holds the finger and thumb locks to prevent the release from firing under high bow poundage in the bow draw sequence. When the archer comes to full draw, the archer releases both the finger and thumb locks and then begins to pull farther back using back-tension, and the release fires when the bow poundage increases due the added pressure to the bow limbs increasing because the bow cams have reached a draw stop or limit, where there is no more string length. Thus, the limbs are actually being pulled farther resulting in greater poundage in the draw.

When the archer chooses to use the release as a relax trigger release, the archer simply rotates the adjustable nut in the opposite direction to achieve generally five pounds less than the bow let-off poundage. As soon as the finger and thumb locks are let go, the release fires instantly, no matter how far back the bowstring is pulled, because the release is adjusted to hold less than any bow draw weight poundage, whether in the valley of the reduced let-off poundage, or anywhere in-between.

While the preferred forms and embodiments of the invention have been illustrated and described, it will become apparent to those of ordinary skill in the art that various changes and modifications may be made without deviating from the inventive concepts set forth above.

What is claimed is:

1. A pull tension archery release, comprising (a) a head;

(b) a bail connected with said head for rotation about a first axis, said bail including at least one radially extending projection configured to hold a bow string;

(c) a sear assembly operable between a hold position wherein said sear assembly engages said bail to prevent rotation of said bail and a release position wherein said sear assembly releases said bail for rotation to release the bow string and fire an arrow; and (d) a locking assembly connected with said head and said sear assembly to lock said head in a fixed position relative to said housing.

2. An archery release as defined in claim 1, and further comprising a cylindrical housing having a longitudinal axis and connected with said head, said sear assembly being arranged in said housing.

3. An archery release as defined in claim 2, wherein said sear assembly includes a sear arranged within housing and along said longitudinal axis, said sear having a first end configured to engage and release said bail, whereby when pull tension is applied to said sear, said sear is displaced away from said bail to release the bow string.

4. An archery release as defined in claim 3, and further comprising a cylindrical pull sleeve containing a chamber, said housing being coaxially arranged in said pull sleave chamber, said pull sleave being connected with a second end of said sear.

5. An archery release as defined in claim 3, wherein said sear includes an annular recess and said locking assembly includes a finger lock pivotally connected with said head, one end of said finger lock being configured to engage said sear recess in a locked position.

6. An archery release as defined in claim 5, and further comprising a thumb lock rotatably connected with said head opposite said finger lock, one end of said thumb lock configured to engage said sear recess in a locked position.

7. An archery release as defined in claim 3, and further comprising a spring arranged within said housing between said sear and said housing, said spring biasing said sear toward the hold position.

8. An archery release as defined in claim 7, and further comprising an adjustable nut arranged within said housing and abutting against said spring, said nut being threadably connected with said housing and operable to adjust a biasing force of said spring on said sear.

9. A pull tension archery release, comprising (a) a head;

(b) a bail connected with said head for rotation about a first axis, wherein said bail includes three equally spaced radially extending projections configured to hold a bow string; and (c) a sear assembly operable between a hold position wherein said sear assembly engages said bail to prevent rotation of said bail and a release position wherein said sear assembly releases said bail for rotation to release the bow string and fire an arrow.

10. A pull tension archery release, comprising (a) a housing having a longitudinal axis and containing a chamber;

(b) a sear assembly configured for engaging a bow string, said sear assembly including a sear arranged within said housing chamber for reciprocal movement along said longitudinal axis between hold and release positions, whereby when pull tension is applied to said sear with said sear assembly engaging the bow string, said sear is displaced to release the bow string; and (c) a locking assembly engaging said sear to lock and release said sear to prevent and permit reciprocal movement, respectively, of said sear relative to said housing.

11. A pull tension archery release as defined in claim 10, wherein said sear assembly further includes a head connected with said sear for movement with said sear relative to said housing.

12. A pull tension archery release as defined in claim 11, and further comprising a bail connected with said head for rotation about an axis normal to said longitudinal axis and including at least one radially extending projection engaged by a first end of said sear when said sear is in said hold position, whereby when said sear is displaced to said release position, said bail rotates to release the bow string.

13. A pull tension archer release as defined in claim 12, wherein said bail includes three equally spaced projections.

14. A pull tension archery release as defined in claim 10, and further comprising a spring arranged in said housing chamber between said sear and said housing, said spring being coaxial with and surrounding a portion of said sear and biasing said sear toward the hold position.

15. A pull tension archery release as defined in claim 14, and further comprising a nut arranged in said housing chamber and threadably connected with said housing to adjust a biasing force of said spring on said sear.

16. A pull tension archery release as defined in claim 10, and further comprising a pull sleeve connected with a second end of said sear and operable by an archer to apply pull tension to said sear.

* * * * *